US010850942B2

(12) United States Patent
Dräger

(10) Patent No.: US 10,850,942 B2
(45) Date of Patent: Dec. 1, 2020

(54) ROLLER GUIDE FOR A CAR OF AN ELEVATOR SYSTEM

(71) Applicant: thyssenkrupp Elevator Innovation and Operations GmbH, Essen (DE)

(72) Inventor: Oliver Dräger, Reutlingen (DE)

(73) Assignees: THYSSENKRUPP ELEVATOR AG, Essen (DE); THYSSENKRUPP AG, Essen (DE)

( * ) Notice: Subject to any disclaimer, the term of this patent is extended or adjusted under 35 U.S.C. 154(b) by 128 days.

(21) Appl. No.: 15/554,093

(22) PCT Filed: Jan. 26, 2016

(86) PCT No.: PCT/EP2016/051496
§ 371 (c)(1),
(2) Date: Aug. 28, 2017

(87) PCT Pub. No.: WO2016/139011
PCT Pub. Date: Sep. 9, 2016

(65) Prior Publication Data

US 2018/0037439 A1 Feb. 8, 2018

(30) Foreign Application Priority Data

Mar. 3, 2015 (DE) ..... 10 2015 103 076

(51) Int. Cl.
*B66B 7/04* (2006.01)
*B66B 11/02* (2006.01)

(52) U.S. Cl.
CPC ..... *B66B 7/046* (2013.01); *B66B 7/048* (2013.01); *B66B 11/02* (2013.01)

(58) Field of Classification Search
CPC ..... B66B 7/046; B66B 7/048
See application file for complete search history.

(56) References Cited

U.S. PATENT DOCUMENTS 2,253,820 A 8/1941 Spiro
2,260,922 A 10/1941 Spiro
(Continued)

FOREIGN PATENT DOCUMENTS

CN 201058782 Y 5/2008
DE 1169627 B 5/1964
(Continued)

OTHER PUBLICATIONS

English Translation of International Search Report issued in PCT/EP2016/051496, dated Apr. 28, 2016 (mailed May 9, 2016).

*Primary Examiner* — Michael A Riegelman
(74) *Attorney, Agent, or Firm* — thyssenkrupp North America, Inc.

(57) ABSTRACT

A roller guide for guiding a car of an elevator system along a guide rail may include a roller carrier that can be attached to the car and several rollers disposed on the roller carrier. The roller may be configured to roll by their respective running surface on a rolling surface of the guide rail. The rollers may each be mounted movably in the roller carrier with a direction component perpendicular to the rolling surface of the guide rail. The rollers may be mounted in operative connection with one another at least in part by way of hydraulic fluid such that a movement of one of the rollers perpendicular to the rolling surface of the guide rail causes a directionally-opposite movement of at least a second of the rollers. The present disclosure also concerns a car and an elevator system that employ such roller guides.

8 Claims, 2 Drawing Sheets

(56) References Cited

U.S. PATENT DOCUMENTS

| | | | | | |
|---|---|---|---|---|---|
| 2,277,565 | A | | 3/1942 | Spiro | |
| 3,329,240 | A | * | 7/1967 | Harwood | B66B 7/046 187/410 |
| 4,347,916 | A | * | 9/1982 | Schroder | B66B 7/046 187/410 |
| 4,724,930 | A | * | 2/1988 | VanLierop | B66F 7/065 187/204 |
| 5,289,902 | A | * | 3/1994 | Fujita | B66B 5/284 187/346 |
| 8,761,947 | B2 | * | 6/2014 | Wang | F16F 9/535 187/228 |
| 2018/0037439 | A1 | * | 2/2018 | Drager | B66B 7/046 |

FOREIGN PATENT DOCUMENTS

| | | | |
|---|---|---|---|
| DE | 1169628 | B | 5/1964 |
| EP | 2 107 031 | A | 10/2009 |
| JP | 1997194163 | A | 7/1997 |
| JP | H09194163 | A | 7/1997 |

* cited by examiner

ROLLER GUIDE FOR A CAR OF AN ELEVATOR SYSTEM

CROSS REFERENCE TO RELATED APPLICATIONS

This application is a U.S. National Stage Entry of International Patent Application Serial Number PCT/EP2016/051496, filed Jan. 26, 2016, which claims priority to German Patent Application No. DE 10 2015 103 076.4 filed Mar. 3, 2015, the entire contents of both of which are incorporated herein by reference.

FIELD

The present disclosure generally relates to elevator systems, including roller guides that provide guidance along guide rails of elevator systems.

BACKGROUND

Cars are moved in elevator shafts by means of guides, especially roller guides, along guide rails. An important criterion for a comfortable ride in a car of an elevator system is quiet, jolt-free running.

However, irregularities may occur in the guiding of cars by means of roller guides along guide rails when they travel over unevenness on the rolling surface of the guide rails. This leads to undesirable forces and accelerations on the rollers of the roller guides, which are transmitted to the car and thus lessen the comfort of the ride.

To enhance the comfort of the ride, the diameters of the rollers used in the roller guides can be increased, which results in less acceleration of the wheel axle when traveling over irregularities on the rolling surface of the guide rails and thus greater comfort. In addition or also alternatively to this, the ride comfort can be enhanced by soft running surfaces of the rollers, since in this case the irregularities of the rolling surface are better absorbed.

In applications with increased axle loads, such as is the case for example in elevator systems with rear wall guidance and corresponding cantilevered suspension of the car, however, limits are set on the softness of the running surface of the rollers, since this softness at the same time reduces the guidance precision. Accordingly, the running surfaces of the rollers must be harder in design, which would ultimately need to be compensated once more by a larger diameter in order to achieve the desired ride comfort. Yet this results in undesirably large rollers in the case of heavy axle loads.

Thus a need exists to enable the highest possible ride comfort even for cars of elevator systems with heavy axle loads.

DETAILED DESCRIPTION

Figure 1:
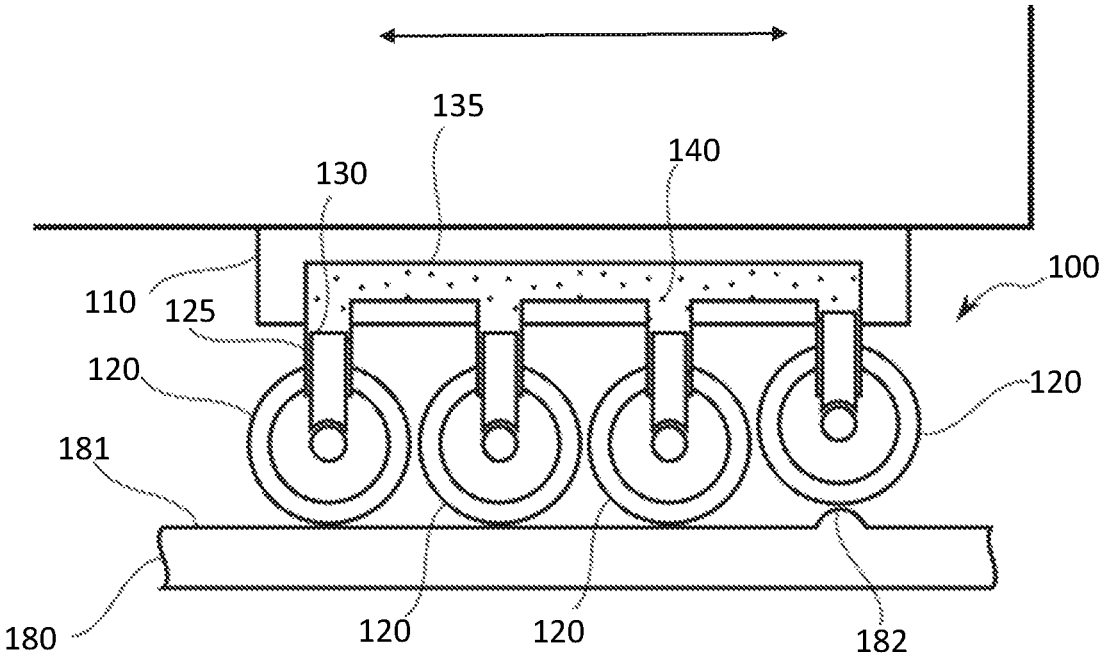
FIG. 1 is a schematic view of an example roller guide.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

A roller guide according to the invention is used for a car of an elevator system for guidance along a guide rail. The roller guide comprises a roller carrier, which can be attached to the car, wherein several rollers are arranged on the roller carrier such that the rollers can roll by their respective running surface on the same rolling surface of the guide rail, and wherein the rollers are each mounted movably in the roller carrier with a direction component perpendicular to the rolling surface of the guide rail.

Thanks to such a roller guide, the force which is transmitted by the roller guide to the guide rail is distributed over several rollers. In this way, the individual rollers can be smaller in design than would be the case for a single roller. Besides a smaller spatial extension of the roller guide in the direction perpendicular to the rolling surface of the guide rail, a roller guide according to the invention at the same time enables greater ride comfort, since possible unevenness on the rolling surface of the guide rail, which is usually of small dimension, generally only affects one of the several rollers. Since the rollers are mounted individually movably in the direction vertical to the rolling surface, each time the unevenness acts only on one roller, while the other rollers continue to provide the regular guidance and therefore balance out the unevenness, at least in part. While it is only critical for each of the rollers to have a perpendicular component in its mounting when the rollers are mounted in the roller carrier, a mounting substantially perpendicular to the rolling surface is preferable, and one entirely perpendicular to the rolling surface is especially preferable, since this accomplishes an especially effective force transmittal on account of avoiding unnecessary bearing loads and friction due to skewed movement and therefore in regard to service life and improved comfort.

The precise number of rollers may be chosen as needed, but at least two rollers are needed for the effect according to the invention. Especially preferable are three or four rollers, but five, six, or more rollers are also conceivable. For sake of completeness, it is further noted that rollers for guidance may also lie against two or three rolling surfaces on a guide rail. In such cases, the roller guide for the other rolling surfaces can likewise be designed according to the invention.

Preferably, the rollers are arranged on the roller carrier spaced apart from each other in regard to their axles in the direction of movement of the car. For this, the rollers may be arranged in a row, for example, with a certain spacing between two rollers. In this way, the force acting on the roller guide by the car can be distributed optimally on the guide rail, while ensuring that the usually local unevenness on the usually narrow guide rails acts each time on only one of the rollers.

It is advantageous to arrange the rollers overlapping on the roller carrier in the direction of movement of the car. For this, the rollers can be arranged overlapping in two rows, for example. In this way, a rapid and soft travel over unevenness can be achieved, thanks to a better distribution of the excitation energy among lower-frequency vibration components. Furthermore, the roller guide can have a compact design, at least in the direction of movement of Advantageously, the rollers are mounted in operative connection with each other, such that a movement of one of the rollers in a direction perpendicular to the rolling surface of the guide rail causes an opposite directed movement of at least one of the other rollers. That is, at least one roller moves in a direction opposite to the first mentioned roller. Thanks to such a coupling, the movement of a first roller which is caused by an unevenness in the rolling surface of the guide rail is compensated by a movement of at least one other roller, preferably if possible by a movement of all other rollers. The force on the first roller is thus reduced directly by the at least one other roller. Furthermore, a possible oscillation of the first roller is also avoided. For example, if a movement of a roller is transmitted uniformly to all other rollers, i.e., if for example one roller is lifted by an unevenness and accordingly all other rollers are uniformly lowered, the roller carrier as a whole is only lifted by an amount corresponding to the displacement of the excited roller divided by the number of rollers. For a more detailed description, refer in this place to the description of the figures.

It is advantageous for the operative connection between the rollers to be formed at least in part by means of a hydraulic fluid. Such a hydraulic operative connection is largely independent of the precise geometrical configuration of the roller guide and can therefore be adapted especially easily to a roller guide or its roller carrier. In addition, a hydraulic force transmittal is easier to design than, for example, a purely mechanical force transmittal. In particular, with a suitable determination of the fluid viscosity of the hydraulic fluid, a dampening of movement can be accomplished which is optimally adapted to the other unavoidable elasticities in the system, such as those of the rollers and the load-bearing components, in the sense that the reverberations following a local unevenness are minimized in time and in amplitude. In addition, no free oscillations occur with a hydraulic operative connection, such as would be the case for example with individually spring-mounted rollers, that is, such a roller guide by means of hydraulic coupling has no additional compliance with regard to forces acting on all rollers at the same time, and which might cause, for example, unwanted oscillations of the car as a whole.

Preferably, the rollers are each mounted movably by means of hydraulic cylinders which are hydraulically interconnected and corresponding pistons. In the context of the present invention, the term hydraulic cylinder is explicitly not limited to a cylindrical shape, even though that is customary for such applications. This enables an especially easy realization of the movably mounted rollers, since hydraulic cylinders can be easily interconnected by hydraulic hoses, for example. However, corresponding channels for example can also be provided in the roller carrier.

Alternatively, the hydraulic fluid is enclosed by an at least partly flexible container, wherein the rollers are each coupled to an external surface of the container so that a movement of the rollers in a direction perpendicular to the rolling surface of the guide rail is transmitted across the external surface of the container to the hydraulic fluid. In this case, no gaskets are needed for roller bearings, since the hydraulic fluid is surrounded entirely by a container, such as one made of rubber, flexible plastic, or a similar material. In this way, by a suitable coupling, one can accomplish a nonlinear force transmittal between roller and hydraulic fluid during the movement of the roller perpendicular to the rolling surface. For example, a greater stiffness can be accomplished for larger deflections of the rollers.

Preferably, the container is arranged on and/or in the roller carrier. This enables an especially compact design.

Advantageously, during a movement of the rollers in a direction perpendicular to the rolling surface of the guide rail, a ratio between a force on the rollers in their direction of movement and a pressure in the hydraulic fluid is at least substantially identical for all rollers. This can be accomplished, in the design with hydraulic cylinders, for example by working surfaces of the pistons which are the same size for the hydraulic fluid each time, and in the design with a container for the hydraulic fluid for example by suitable configuration of the container and the coupling of the rollers to the external surface of the container. In this way, one can accomplish the most effective possible reduction of the force transmittal from the unevenness on the guide rail to the roller guide and thus to the car, since none of the rollers transmits an increased force when passing over the unevenness. The ride comfort is optimally increased in this way.

A car of an elevator system according to the invention comprises at least one roller guide according to the invention.

An elevator system according to the invention comprises at least one car according to the invention and at least one guide rail.

Regarding the advantages and advantageous embodiments of the car according to the invention and the elevator system according to the invention, refer to the above remarks on the roller guide according to the invention in order to avoid repetition.

Further advantages and embodiments of the invention will emerge from the description and the enclosed drawing.

Of course, the features mentioned above and to be further explained below may be used not only in the particular indicated combination, but also in other combinations or standing alone, without leaving the scope of the present invention.

The invention is represented schematically in the drawing with the aid of sample embodiments and shall be described below with reference to the drawing.

FIG. 1 shows schematically a roller guide 100 according to the invention in a preferred embodiment. The roller guide 100 comprises a roller carrier 110 and for example four rollers 120. Furthermore, a guide rail 180 is shown, along which the roller carrier 100 can be moved. The roller guide 100 can be attached by the roller carrier 110 to a car of an elevator system, for example a simple screw fastener can be provided for this.

Such a car usually has several roller guides. Furthermore, it should be mentioned that the usual direction of movement of the car and thus also of the roller guide 100 is vertical in an elevator shaft along the corresponding guide rail 180, while in the figure the direction of movement is horizontal for the sake of clarity.

The guide rail 180 has a rolling surface 181, against which the rollers 120 lie by their respective running surface and roll along in normal operation. Furthermore, an unevenness 182 is shown in the rolling surface 181, which may involve for example a soiled area, a damaged site, or a welded seam.

The rollers 120 each have a piston 130, at which the rollers 120 are mounted at one end, able to rotate about their respective axles. The pistons 130 are arranged in corresponding hydraulic cylinders 125 and mounted movably in the direction perpendicular to the rolling surface 181. The corresponding mounting and any additionally required supporting devices to prevent the rollers from falling out are not shown, for the sake of clarity.

The hydraulic cylinders 125 are arranged in the roller carrier 110 or form part of the roller carrier 110. The four hydraulic cylinders 125 shown are joined together by a channel 135. In this channel 135, which may be for example a bore in the roller carrier 110, a hydraulic fluid 140 is present.

All the pistons 130 are subjected to the hydraulic fluid 140 at one end. The surfaces of the pistons 130 exposed to the hydraulic fluid 140 are all the same size in the present case, so that the force transmittal between a piston and the hydraulic fluid 140 during a movement of the corresponding roller perpendicular to the rolling surface 181 is the same for all rollers 120.

If, now, one of the rollers 120 passes over an unevenness 182 during its rolling along the guide rail 180, i.e., during a movement of the corresponding car, as is shown for example for the right roller in FIG. 1, this roller will be lifted or pressed into the roller carrier 110. Accordingly, the other three rollers will be lowered or pressed out from the roller carrier 110.

The height or stretch by which the right roller is pressed into the roller carrier 110 is uniformly distributed by the hydraulic fluid 140 over the other three rollers, i.e., each of these other three rollers is only pressed by a third of this height or stretch out from the roller carrier. This results in a lifting of the right roller with respect to the rolling surface by the height of its pressing into the roller carrier and in addition by a third of this height, i.e., the height by which each of the other three rollers is forced out from the roller carrier 110. Hence, the roller carrier 110 will be lifted only by a quarter of the height of the irregularity 182 with respect to the rolling surface 181.

For further illustration, this lifting of the roller carrier 110 shall be illustrated by a concrete example. For a height of the irregularity 182 of 4 mm with respect to the rolling surface 181, the right roller will be pressed by 3 mm into the roller carrier 110. This 3 mm will be uniformly distributed among the other three rollers, which therefore are each pressed by 1 mm out from the roller carrier. The height difference between the right roller and the other three rollers is thus 4 mm, while the roller carrier 110 as a whole is only lifted by 1 mm with respect to the rolling surface 181.

This shows that with a roller guide according to the invention the roller carrier is lifted much less when passing over an irregularity than would be the case for a single roller, which would be lifted by the full height of the irregularity.

Figure 2:
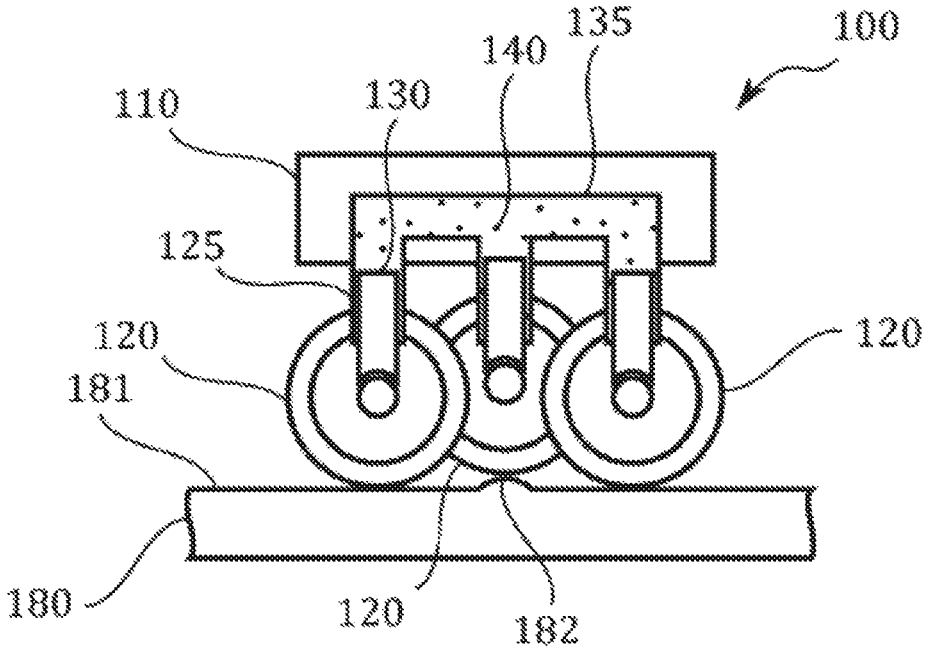
FIG. 2 is a schematic view of another example roller guide.

FIG. 2 shows schematically a roller guide 100 according to the invention in another preferred embodiment. The roller guide 100 differs from the roller guide of FIG. 1 in that, on the one hand, only three rollers 120 are provided, and on the other hand the rollers 120 overlap in the direction of movement of the roller guide 100 or the car.

This overlapping makes possible a compact roller guide, at least in the direction of movement of the car, while in the direction perpendicular to the plane of the drawing a broader extension may be achieved. The mode of functioning of the roller guide per FIG. 2, however, does not differ from that of FIG. 1, with the difference that a lifting of a roller is transmitted over only two and not three other rollers.

However, thanks to the shorter distance between two rollers, the irregularity is passed over by two consecutive rollers in a shorter distance. This means that, depending on the length of the irregularity in the direction of movement of the car, the second roller may already be lifted while the first roller is still being lowered. This results in a gentler movement sequence and thus also enhances the ride comfort.

Figure 3:
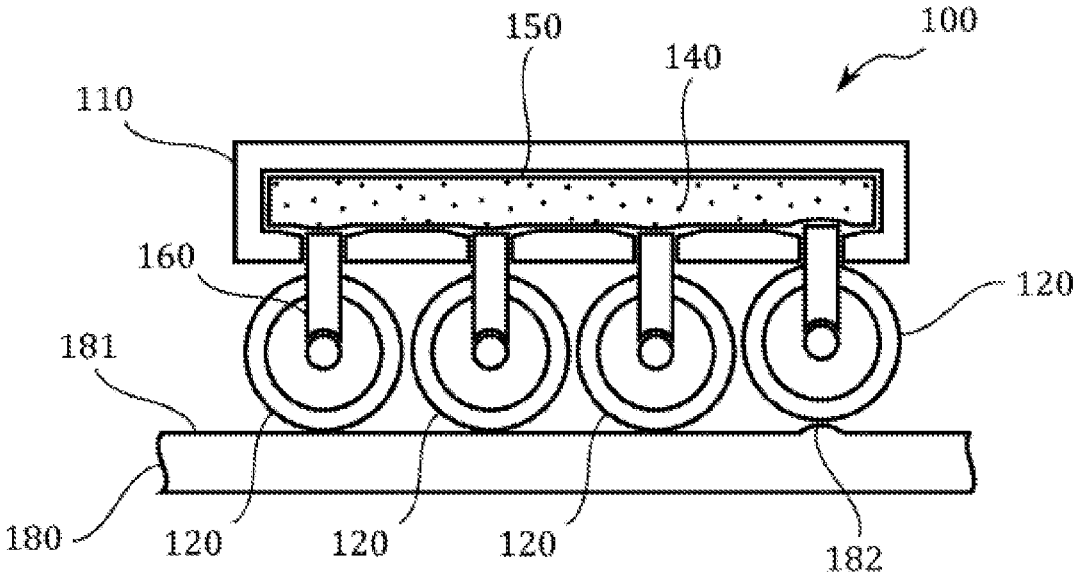
FIG. 3 is a schematic view of still another example roller guide.

FIG. 3 shows schematically a roller guide 100 according to the invention in another preferred embodiment. Contrary to the embodiment of FIG. 1, the rollers 120 are not mounted by interconnected hydraulic cylinders and corresponding pistons.

The rollers 120 each have a support 160, on which the rollers 120 are mounted at one end, able to rotate about their respective axles. The supports 160 are arranged in corresponding openings in the roller carrier 110 and mounted movably in a direction perpendicular to the rolling surface 181. The corresponding mounting and any additionally required holding devices which protect the rollers from dropping out are not further shown for purposes of clarity.

The roller carrier 110 in the present case has a cavity inside it, in which a container 150 is arranged. The container is made for example from a flexible plastic, rubber, or a similar material and it encloses the hydraulic fluid 140. The supports 160 of the rollers 120 are coupled to an external surface of the container 150 so that both a movement of a support into the roller carrier 110 is transmitted to the hydraulic fluid 140 and a pressure change in the hydraulic fluid 140 is transmitted to the supports.

A movement of a roller into the roller carrier 110, as is represented by way of example by the irregularity 182 at the right roller, therefore results in a movement of the other three rollers out from the roller carrier 110. Similar to the embodiments of FIGS. 1 and 2, the movement of the right roller is distributed at least approximately uniformly among the other rollers, so that these other three rollers are only pressed out by around a third of the height by which a roller is pressed into the roller carrier 110.

In order to achieve the most uniform possible force transmittals between the supports 160 and the hydraulic fluid 140, attention needs to be given to a suitable configuration of the container 150 and the sites of the coupling to the supports 160. It is advantageous also for the force transmittal to be nonlinear. This may occur at the cost of a uniform force transmittal, but to the benefit of other desirable properties of the roller guide, such as greater stiffness for larger deflections.

It should be mentioned in this place that, thanks to such a nonlinearity of the hydraulic cross section in dependence on the deflection, an exactly uniform distribution for any given deflections is difficult to realize. Although the fluid volume forced inward corresponds to the sum of the fluid volumes forced outward, how this is manifested in the deflections will depend on the local cross sectional area, i.e., the shape of the ram and the vessel. For example, progressive and likewise degressive curves are conceivable, wherein dynamic stability considerations may also play a role in addition to the sought comfort behavior.

What is claimed is:

1. A roller guide for guiding a car of an elevator system along a guide rail, the roller guide comprising:

a roller carrier that is attachable to the car of the elevator system, the roller carrier including hydraulic cylinders provided with hydraulic fluid, each of the hydraulic cylinders including a corresponding piston movably disposed therein responsive to changes in pressure of the hydraulic fluid;

rollers that are disposed on the roller carrier, each of the rollers having a running surface, wherein each running surface of the rollers is configured to roll along a rolling surface of the guide rail, wherein each of the rollers is mounted to a corresponding piston so as to be individually movable in a perpendicular direction relative to the rolling surface of the guide rail responsive to movement of the corresponding piston; and wherein the hydraulic cylinders are hydraulically interconnected by way of the hydraulic fluid such that a movement of one of the rollers in the perpendicular direction causes a directionally-opposite movement of at least a second of the rollers.

2. The roller guide of claim 1 wherein the rollers are disposed on the roller carrier spaced apart from one another with respect to axles of the rollers in a direction of movement of the car.

3. The roller guide of claim 1 wherein the rollers overlap one another on the roller carrier in a direction of movement of the car.

4. The roller guide of claim 1 wherein the hydraulic fluid is enclosed by an at least partly flexible container, wherein each of the rollers is coupled to an external surface of the at least partly flexible container so that movement of the rollers in the perpendicular direction is transmitted across the external surface of the at least partly flexible container to the hydraulic fluid.

5. The roller guide of claim 4 wherein the at least partly flexible container is disposed on and/or in the roller carrier.

6. The roller guide of claim 1 wherein during movement of the rollers in the perpendicular direction a ratio between a force on the rollers in their direction of movement and a pressure in the hydraulic fluid is substantially equal for all the rollers.

7. A car of an elevator system comprising at least one roller guide, wherein the at least one roller guide comprises:

a roller carrier that is attachable to the car, the roller carrier including hydraulic cylinders provided with hydraulic fluid, each of the hydraulic cylinders including a corresponding piston movably disposed therein responsive to changes in pressure of the hydraulic fluid;

rollers that are disposed on the roller carrier, each of the rollers having a running surface, wherein each running surface of the rollers is configured to roll along a rolling surface of the guide rail, wherein each of the rollers is mounted to a corresponding piston so as to be individually movable movable in a perpendicular direction relative to the rolling surface of the guide rail responsive to movement of the corresponding piston; and wherein the hydraulic cylinders are hydraulically interconnected by way of the hydraulic fluid such that movement of one of the rollers in the perpendicular direction causes a directionally-opposite movement of at least a second of the rollers.

8. An elevator system with at least one car and at least one roller guide, wherein the at least one roller guide comprises:

a roller carrier that is attachable to the at least one car, the roller carrier including hydraulic cylinders provided with hydraulic fluid, each of the hydraulic cylinders including a corresponding piston movably disposed therein responsive to changes in pressure of the hydraulic fluid;

rollers that are disposed on the roller carrier, each of the roller having a running surface, wherein each running surface of the rollers is configured to roll along a rolling surface of the guide rail, wherein each roller is mounted to a corresponding piston so as to be individually movable in a perpendicular direction relative to the rolling surface of the guide rail responsive to movement of the corresponding piston; and wherein the hydraulic cylinders are hydraulically interconnected by way of the hydraulic fluid such that movement of one of the rollers in the perpendicular direction causes a directionally-opposite movement of at least a second of the rollers.

* * * * *